United States Patent [19]

Funck et al.

[11] 4,159,862

[45] Jul. 3, 1979

[54] REMOVABLE FEMALE POLARIZING GUIDE FOR ELECTRICAL CONNECTORS

[75] Inventors: Gordon W. Funck, Crystal; Robert J. Melcher, Edina, both of Minn.

[73] Assignee: Fabri-Tek Incorporated, Minneapolis, Minn.

[21] Appl. No.: 859,382

[22] Filed: Dec. 12, 1977

[51] Int. Cl.[2] ..... H01R 13/64

[52] U.S. Cl. ..... 339/186 M

[58] Field of Search ..... 339/184 R, 184 M, 186 R, 339/186 M, 217 S

[56] References Cited

U.S. PATENT DOCUMENTS

| | | | |
|---|---|---|---|
| 2,979,689 | 4/1961 | Jackson et al. | 339/217 S |
| 3,004,238 | 10/1961 | Damon | 339/217 S |
| 3,085,221 | 4/1963 | Kelly | 339/186 M |
| 3,714,617 | 1/1973 | Bright et al. | 339/186 M |
| 3,853,381 | 12/1974 | Morningstar | 339/92 M |

*Primary Examiner*—Neil Abrams

*Attorney, Agent, or Firm*—Malcom D. Reid

[57] ABSTRACT

A female guidance and polarizing means for either the male or female parts of a separable electrical connector which carry mating eletrical contacts. The polarizing and guide means is mounted in predetermined positions on either the male or female connector parts. The removable bushing has a portion which is keyed to the male polarizing pin to permit the connector parts to be mated only when the correct parts are presented to each other. The removable female polarizing guide bushing is made of resilient plastic material having a keyway, a flange, a polygonal body section, and a plurality of fingers with shoulders for engagement with the connector parts. The bushing is inserted into a bore in the connector body. The bore comprises a series of three axially aligned apertures. The fingers snap into one of these apertures and the bushing is thereby retained from moving longitudinally in one direction. The flange fits into an aperture which has a diameter greater than that of the flange. The aperture in which the body is located has a transverse dimension less than the diameter of the flange thereby arresting longitudinal movement direction of the bushing. The polygonal shape of the body of the female polarizing guide gushing and the corresponding polygonal shape of the apertures in the connector body arrests rotational movement of the female polarizing guide bushing.

13 Claims, 4 Drawing Figures

REMOVABLE FEMALE POLARIZING GUIDE FOR ELECTRICAL CONNECTORS

BACKGROUND OF THE INVENTION

1. Field of the Invention

This invention relates to a removable female polarizing guide for separable electrical connectors. The removable female polarizing guide acts as both a polarizing means and a guide means. The polarizing guide bushing is inserted in a predetermined angular orientation about its longitudinal axis, in a bore in an electrical connector to prevent the interconnection of electrical connectors which are not mates and to guide the electrical connectors into mating engagement.

2. History of the Prior Art

In the past snap in polarizing and guidance means have been used in conjunction with electrical connectors. They have, however, not provided for ease of removal or for economy in manufacture. The present invention is easily removable with special tools and allows a molding technique for the receiving bore in the electrical connector body which is more economical than previously allowed.

SUMMARY OF THE INVENTION

This invention relates to a removable female polarizing guide for separable electrical connectors. It is comprised of a connector body with a bore in it and a removable female polarizing guide bushing. The bushing acts as both a polarizing means and a guide means. The bushing is easily removable so that polarization may be changed in the field without special tools. The bore for retaining the bushing is easily moldable by conventional techniques and is, therefore, economical to produce.

BRIEF DESCRIPTION OF THE DRAWINGS

For a more complete understanding of the present invention and for further objects and advantages thereof, reference may be now had to the following description taken in conjunction with the accompanying drawings in which.

DETAILED DESCRIPTION

Figure 1:
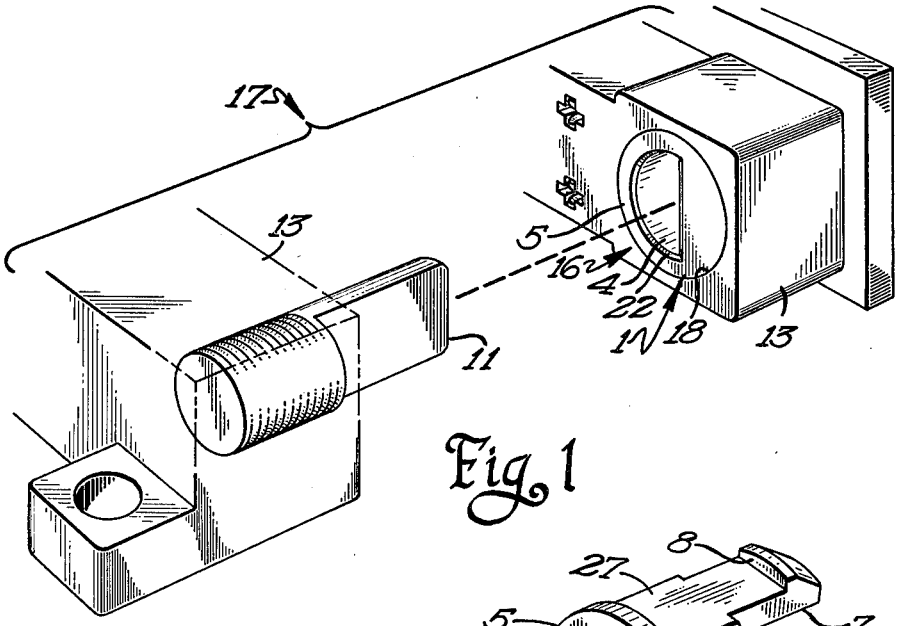
FIG. 1 is a perspective view of a separable electrical connector having a removable female polarizing guide of the present invention aligned for mating.

Referring to FIG. 1, there is shown a removable female polarizing guide 16 in a separable electrical connector 17 constructed in accordance with the invention and having a bushing 1 and a bore 2.

Figure 2:
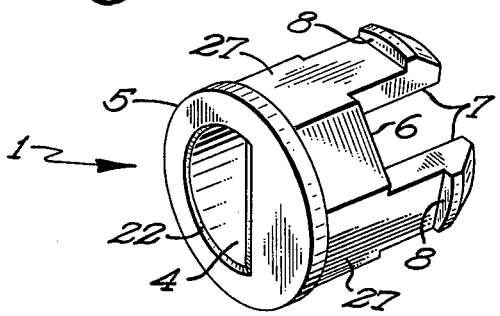
FIG. 2 is a perspective view of the female polarizing guide bushing of the present invention.
Figure 3:
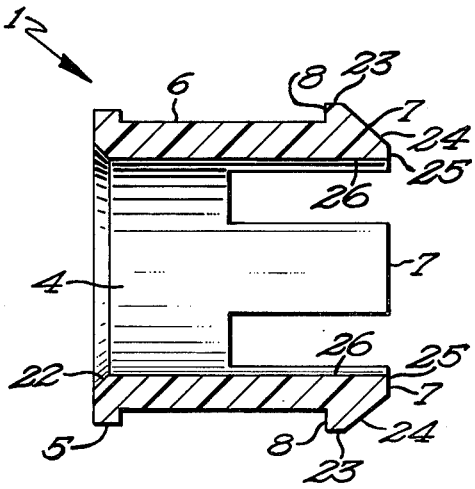
FIG. 3 is a cross-section view of the female polarizing guide bushing of the present invention.

Referring now to FIG. 2, the bushing 1 is shown and comprises a flange 5, a polygonal body 6, a plurality of fingers 7 having shoulders 8. The bushing 1 is fabricated from rigid, yet resilient material, such as plastic.

Figure 4:
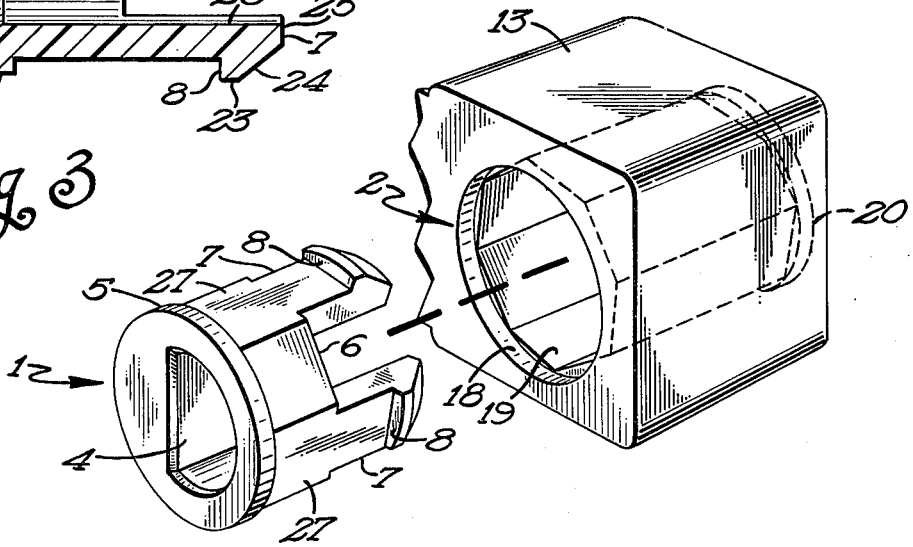
FIG. 4 is a perspective view of a connector body having a bore of the present invention aligned for insertion of the bushing of the present invention.

Referring now to FIG. 4, the bore 2 is shown and comprises three axially aligned apertures. These apertures are the flange aperture 18, the body aperture 19 and the shoulder aperture 20. The bushing 1 is inserted in the bore 2 by a longitudinal force directed along the bushing's axis in a direction from the flange of the bushing to the fingers thereof. The bushing 1 is retained in the bore 2 by the fingers 7 having radially extending shoulders 8 and by the flange 5. The shoulders 8 snap into the shoulder aperture 20. The shoulder aperture 20 has a diameter greater than that of the axially aligned body aperture 19 which houses the body 6 and that part of the fingers 7 extending from the body 6 to the shoulders 8. The flange is seated in the flange aperture 18. The flange aperture 18 has a diameter greater than that of the axially alinged body aperture 19. The flange aperture and the shoulder aperture are longitudinally disposed so that the body aperture is longitudinally located between them. The combination of the flange 5 and the shoulders 8 arrest any longitudinal movement of the bushing 1 in the bore 2 once the bushing 1 is fully inserted in the bore 2. The flange 5 is round in the preferred embodiment of the invention.

The top of the bushing 1 has a longitudinally directed non-round keyway 4 extending through the flange 5 and body 6. The mating male polarizing pin 11 is inserted in the keyway 4 when properly polarized mating separable electrical connectors 17 having a removable female polarizing guide 16 are engaged. The keyway has a keyway bevel 22 which allows for ease of insertion of the male polarizing pin 11 during the initial phase of mating of the male polarizing 11 and the bushing 1. The fingers 7 extend from the body 6 of the bushing 1. The body 6 is of a polygonal shape. The embodiment shown has an octagonally shaped body 6. A finger 7 extends from every other body side 27. Each finger 7 has a shoulder 8 which extends radially from the finger 7 in a direction away from a longitudinal axis through the bushing 1. The finger 7 flexes in a transverse direction allowing the finger 7 to deflect towards the longitudinal axis of the bushing while the shoulder 8 is passing through the body aperture 19 of the bore 2 upon insertion of the bushing 1 in the bore 2. The flexible nature of the fingers 7 resulting from both the shape of the fingers 7 and the nature of the plastic material of which the bushing 1 is made allows the fingers 7 to resume their position when the bushing 1 is fully inserted in the bore 2 to the point where the shoulders 8 pass out of the body aperture 19 and into the larger diameter of the shoulder aperture 20. The flexible nature of the fingers 7 makes it possible to easily insert the bushing 1 by hand. It also allows removal of the bushing 1 with a light longitudinal force directed from the fingers 7 of the bushing to the flange 5 thereof. This force may be exerted with a tool so simple that it may even be fashioned in the field from a paper clip. The paper clip is first straightened and then a small hook is formed on one end of the wire. The wire with the hook is inserted in the keyway 4 and hooked on the body 5 between the fingers 7. A firm force directed from the fingers 7 towards the flange 5 will cause the fingers 7 to flex towards the center of the bushing 1 and allow the shoulders 8 to slip into the body aperture 19 and out of the bore 2. The removed bushing 1 can then be re-inserted in the bore 2 in a different angular position relative to the longitudinal axis of the bushing 1.

The bushing 1 is held in predetermined angular position due to the polygonal shape of its body 6 and the corresponding polygonal shape of the body aperture 19. The mating of the polygonal body 6 wth the polygonal body aperture 19 arrests the rotational movement of the bushing 1. The polygonal shape of the body 6 and body aperture 19 allows for a predetermined number of possible angular positions of the bushing 1 in the connector body 13. The ease of removability feature allows for an in-field-change of polarization by repair technicians, design engineers, or other such individuals. Due to the resiliency of the plastic material from which the bushing 1 is made and the flexible nature of the fingers 7 due to their shape and the resilient material from which they are fabricated, the bushing 1 is capable of being engaged and disengaged from the bore 2 in the connector body 13 repeatedly without being damaged.

The smaller diameter of the body aperture 19 relative to either the flange aperture 18 or the shoulder aperture 20 and its disposition between the flange aperture 19 and the shoulder aperture 20 allows for an economical molding of the bore 2 in the connector body 13. Conventional molding techniques use a mold with two halves. Each half has a core pin extending to meet the core pin of the corresponding other half of the mold. These abuting core pins form the bore 2 in a connector body 13 when the mold is injected with plastic and allowed to set. The core pin necessary to form the bore 2 of this invention is easily removed from the bore 2 after the plastic cures. If the body aperture 19 were of a larger diameter than the flange aperture 18 and the shoulder aperture 20, the core pin could not be pulled out of the connector body 13 after the plastic from which it is formed had been molded and cured. Special molding techniques must be used to remove the core pins in the case where there is an inner recess as would exist if the body aperture 19 diameter were smaller than the flange aperture 18 diameter and the shoulder aperture 20 diameter. This special technique is slower, more costly and results in a greater percentage of rejected parts.

In the preferred embodiment, the shoulder 8 adjoins a lip 23. The lip 23 is disposed in a direction extending from the shoulder 8 and longitudinally away from the body 6. A shoulder bevel 24 adjoins the lip 23 and is disposed inward towards the longitudinal axis of the bushing 1. The shoulder bevel 24 forms a lead in point for the bushing 1. The shoulder bevel 24 meets the leading surface 25 which is a surface which meets the interior surface 26 of the finger 7. Both the lip 23 and the leading surface are strengthening means for the shoulder 8 and the shoulder bevel 24, respectively. The shoulder bevel 24 serves the further purpose of allowing the bushing 1 to be more easily removable from the bore 2.

The dimension from the point where the leading surface 25 meets the shoulder bevel 24 on one finger 7 to the same point on a diametrically opposed finger is less than the dimension of the body aperture 19. When the bushing 1 is inserted in the bore 2, the shoulder bevel 24 makes contact with the body aperture 19, which causes the fingers 7 to deflect towards the longitudinal axis of the bushing 1 so that the lips 23 are allowed to pass through the body aperture 19. At the point of full insertion of the bushing 1 in the bore 2 the lip 23 moves out of the body aperture 19 and into the shoulder aperture 20 which allows the fingers 7 to return to their original positions as the shoulders 8 snap into the shoulder aperture 20 due to the restorative resilience of the bushing 1 material.

Having described the invention with certain specific embodiments thereof, it is to be understood that further modifications may now suggest themselves to those skilled in the art and this specification is intended to cover such modifications as fall within the scope of the appended claims.

What is claimed is:

1. A removable female polarizing guide for separable electrical connectors, comprising (a) a connector body having a bore with axially aligned flange, body and shoulder apertures, the body aperture having a smaller diameter than either the flange or shoulder apertures with the body aperture longitudinally located between the flange and the shoulder aperture, the body aperture having a polygonal shape; and (b) a bushing matingly engaged with the bore having (i) a flange;

(ii) a polygonal body section axially aligned with the flange having a diameter smaller than that of the flange and having a nonround keyway extending longitudinally through the body and through the flange; and (iii) at least one finger extending longitudinally from a side of the body having a shoulder which extends radially from the finger in a direction away from a longitudinal axis through the bushing, said flange and shoulder being received in said flange and shoulder aperatures, respectively.

2. The removable female polarizing guide of claim 1, wherein the finger has a shoulder bevel which adjoins the shoulder and is disposed inwards towards the longitudinal axis of the bushing adjoining the interior surface of the finger.

3. The removable female polarizing guide of claim 2, wherein the finger has a lip which adjoins the shoulder and the shoulder bevel.

4. The removable female polarizing guide of claim 2, wherein the finger has a leading surface which adjoins the shoulder bevel and the interior surface of the finger.

5. The removable female polarizing guide of claim 1, wherein the finger has a lip which adjoins the shoulder; a shoulder bevel which adjoins the lip and is disposed inwards towards the longitudinal axis of the bushing; and a leading surface which adjoins the shoulder bevel and the interior surface of the finger.

6. A removable female polarizing guide of claim 1, wherein the bushing has a plurality of fingers annularly arranged around and extending from the body.

7. A removable female polarizing guide of claim 1, wherein said at least one finger is resiliently deformable whereby said at least one finger is depressed when the finger is inserted into the body aperture and whereby said at least one finger is restored to its original shape when the shoulder passes into the shoulder aperture thereby retaining the bushing within the bore.

8. A removable female polarizing guide bushing for separable electrical connectors, comprising (a) a flange;

(b) a polygonal body section axially aligned with the flange having a diameter smaller than that of the flange and having a nonround keyway extending longitudinally through the body and through the flange; and (c) at least one finger extending longitudinally from a side of the body having a shoulder which extends radially from the finger in a direction away from a longitudinal axis through the bushing wherein said at least one finger is resiliently deformable.

9. The removable female polarizing guide bushing of claim 8, wherein the finger has a shoulder bevel which adjoins the shoulder and is disposed inwards towards the longitudinal axis of the bushing adjoining the interior surface of the finger.

10. The removable female polarizing guide of claim 9, wherein the finger has a lip which adjoins the shoulder and the shoulder bevel.

11. The removable female polarizing guide bushing of claim 9, wherein the finger has a lip which adjoins the shoulder bevel and the interior surface of the finger.

12. The removable female polarizing guide bushing of claim 9, wherein the finger has a lip which adjoins the shoulder; a shoulder bevel which adjoins the lip and is disposed inwards towards the longitudinal axis of the bushing; and a leading surface which adjoins the shoulder bevel and the interior surface of the finger.

13. A removable female polarizing guide bushing of claim 8, wherein the bushing has a plurality of fingers annularly arranged around and extending from the body.

* * * * *